United States Patent [19]

Ahrel

[11] 4,187,141

[45] Feb. 5, 1980

[54] METHOD OF PRODUCING BLEACHED MECHANICAL PULP

[75] Inventor: Bo Ahrel, Montreal, Canada

[73] Assignee: ALF Societe Anonyme, Fribourg, Switzerland

[21] Appl. No.: 916,515

[22] Filed: Jun. 19, 1978

Related U.S. Application Data

[63] Continuation of Ser. No. 659,377, Feb. 19, 1976, abandoned.

[30] Foreign Application Priority Data

Feb. 24, 1975 [SE] Sweden ..... 7502060

[51] Int. Cl.[2] ..... D21B 1/02; D21B 1/04; D21B 1/16

[52] U.S. Cl. ..... 162/23; 162/26; 162/28; 162/56; 162/65; 162/78; 162/80; 162/86; 162/90; 241/18; 241/28

[58] Field of Search ..... 162/17, 18, 19, 23, 162/24, 25, 26, 28, 37, 38, 40, 56, 57, 63, 65, 68, 70, 71, 78, 80, 84, 86, 90, 91, 96, 97, 99, 29, 64; 8/110, 111; 241/17, 18, 21, 23, 27, 28

[56] References Cited

U.S. PATENT DOCUMENTS

| | | | |
|---|---|---|---|
| 1,987,195 | 1/1935 | Kipper | 162/23 |
| 2,958,622 | 11/1960 | Sparrow | 162/78 X |
| 3,558,428 | 1/1971 | Asplund et al. | 162/86 X |
| 3,652,385 | 3/1972 | Noreus et al. | 162/26 X |
| 3,808,090 | 4/1974 | Logan et al. | 162/23 |
| 3,811,993 | 5/1974 | Ghisoni | 162/56 X |

FOREIGN PATENT DOCUMENTS

| | | | |
|---|---|---|---|
| 838893 | 6/1960 | United Kingdom | 162/26 |

*Primary Examiner*—Arthur L. Corbin
*Attorney, Agent, or Firm*—Eric Y. Munson

[57] ABSTRACT

Method of producing mechanical pulp of improved brightness and light-scattering properties in a defibration apparatus in which wood chips are ground between a pair of discs which rotate relative to one another in a pressurized grinding zone. Prior to the defibrating process, the chips are impregnated with a solution of alkali, selected from the group consisting of sodium hydroxide, alkali silicate, alkali carbonate and alkali bicarbonate, and peroxide, surplus impregnating solution is removed from the chips by compression of the chips, the chips are introduced into a pressure vessel which is in communication with the grinding zone and compressed air is introduced into the pressure vessel in an amount sufficient to maintain the chips in the pressure vessel at a temperature below 90° C. and to maintain superatmospheric pressure within the defibrating zone.

3 Claims, 1 Drawing Figure

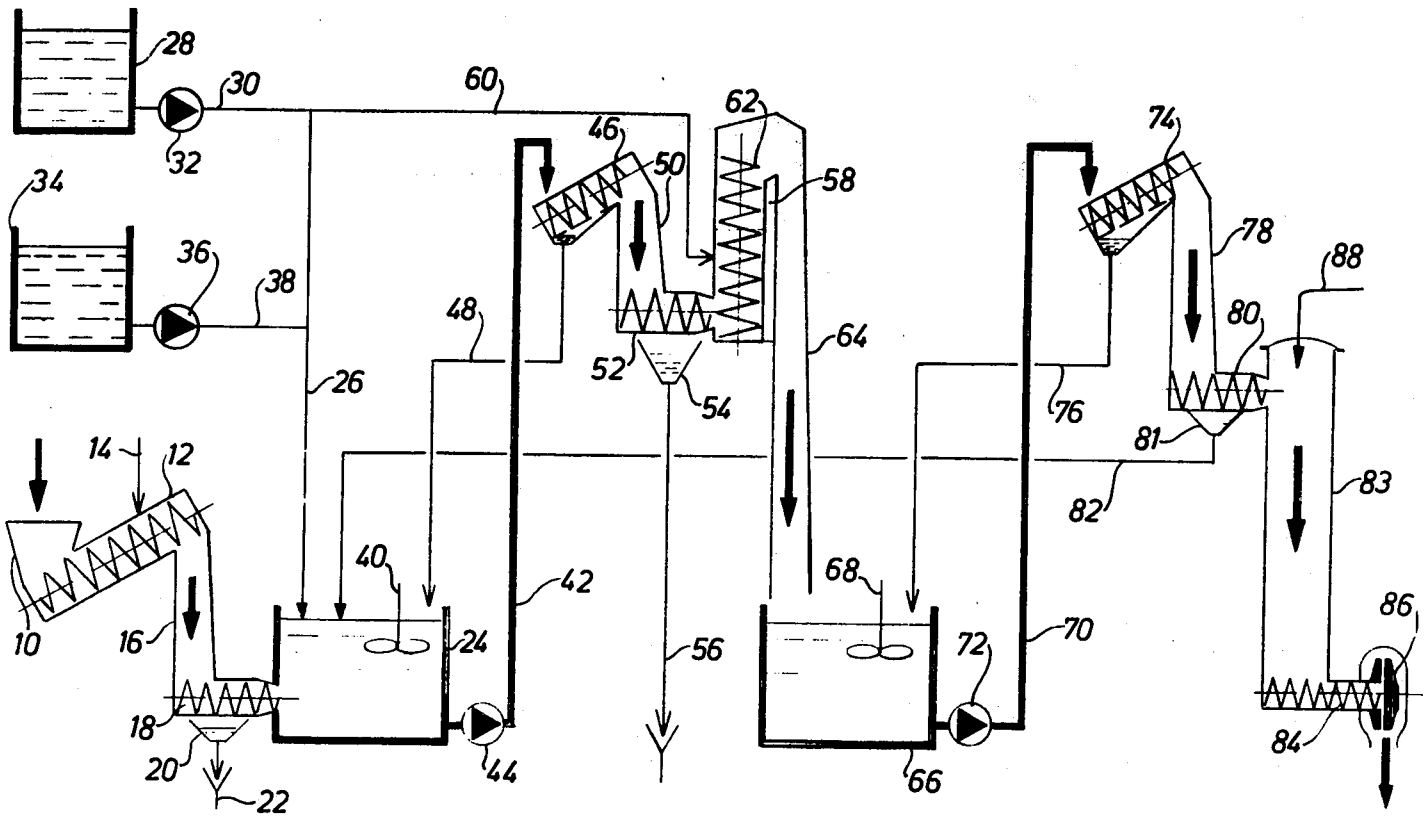
10
12
14
16
18
20
22
24
26
28
30
32
34
36
38
40
42
44
46
48
50
52
54
56
58
60
62
64
66
68
70
72
74
76
78
80
81
82
83
84
86
88

METHOD OF PRODUCING BLEACHED MECHANICAL PULP

This is a continuation of application Ser. No. 659,377, filed Feb. 19, 1976, now abandoned.

BACKGROUND OF THE INVENTION

Semi-chemical pulp is produced generally by the so-called cold soda process wherein wood chips are impregnated with sodium hydroxide and after storage for some time in a reaction vessel, they are defibrated, which usually is effected in a disc-equipped grinding apparatus, whereupon the ground pulp is relieved from residues of chemicals by washing.

Sometimes in the production of mechanical pulp, the wood is impregnated with a weak alkali solution in order to swell the wood fibres and to increase the strength of the fibre coherence in the final product. However, all alkali treatment results in a deterioration of the optical properties of the pulp such as brightness and light-scattering properties thereof. These changes are particularly conspicuous when deciduous wood is used for making pulp in this manner.

SUMMARY OF THE INVENTION

One purpose of the invention, among others, is to reduce the deterioration of the brightness and light-scattering properties of the pulp. According to this invention, alkaline chemicals are admixed with the fibrous starting material prior to its introduction into a pressure vessel which forms part of the grinding apparatus, and the pressure in the grinding apparatus is wholly or partly produced by compressed air.

Another way to reduce discoloration from the alkali treatment is to use alkaline chemicals with lower alkalinity, such as alkali silicate, alkali carbonate or alkali bicarbonate, instead of sodium hydroxide.

The penetration of chemicals into the starting material can be enhanced in a conventional manner by means of pressure impregnation or by steaming the starting material directly before the introduction into the chemical solution.

In the subsequent defibration in a disc-equipped grinding apparatus, the temperature, due to the friction heat developed at least near the end of the grinding process, normally will run up to at least about 100° C. In a closed grinding apparatus subjected to steam overpressure, the temperature will exceed 100° C. Grinding alkalized starting material at such high temperature has proved to have a deleterious effect on the brightness and opacity of the ground pulp. According to the present invention, it has been found advantageous to lower the temperature during the grinding operation in a pressurized grinding apparatus by supplying compressed air to the pressure vessel through which the starting material is fed to the grinding members. In this connection, it is suitable to supply such an amount of compressed air that the starting material at the inlet to the grinding space will have a temperature of not more than 90° C.

In order to obtain a better and more uniform impregnation, it has proved necessary to retain the impregnated chips in the impregnation solution, or after the impregnation, for at least 10 minutes, preferably 20 minutes. A retention period exceeding 2 hours appears not to result in any further improvement.

Alkaline defibration is especially advantageous in the production of pulp from various inferior raw or starting materials such as greenchips (which means chips obtained by grinding all cellulose-containing material from trees including fresh bough and leaves sawdust, straw, bagasse or the like. These starting materials yield, however, a rather dark-coloured pulp, which is also the case when pulp is produced by alkaline defibration of deciduous wood. These facts render bleaching of the pulp still more essential. According to the invention, it is particularly advantageous in this connection to treat the starting material with bleaching agent prior to the defibration with peroxide and alkali and, of course, if necessary with usual chemical adjuvants such as e.g. water glass, magnesium salt or complex forming substances. This renders possible an alkali treatment highly advantageous per se for the strength properties of the pulp prior to the defibration without imparting too low of a brightness to the pulp.

in order to obtain full bleaching effect, it is necessary to retain the impregnated starting material for some time together with bleaching agents at increased temperature. it has been established that the temperature must not exceed 80° C., since at higher temperatures the peroxide is decomposed rapidly. Optimal temperature is generally regarded to be about 60° C. to 70° C. A temperature down to about 50° C. may also be maintained, but then the time of retention must be closer to 2 hours. At 80° C, a retention time of 10 minutes has proved to be sufficient, but a more effective utilization of the peroxide is obtained by operating at a temperature of about 70° C. and with a period of retention of at least 20 minutes.

According to the present invention, a considerably lesser impairment of brightness and light-scattering properties of the resultant pulp can be obtained when the chips are compressed and dewatered to a high dry content prior to their introduction into the grinding apparatus. Thus, residues of chemicals and dissolved wood substance or lignocellulose which have a deleterious effect on brightness and light-scattering properties of the final pulp are removed.

When all peroxide has been consumed, the optical properties of the fibres will deteriorate by continued storage of alkalized fibre raw material, especially if this takes place at increased temperature.

Therefore, temperature and time of retention prior to the defibration must be chosen so that not all peroxide is consumed, but so that a certain content of peroxide remains at the moment the material to be disintegrated is introduced into the grinding apparatus.

Therefore, the temperature of defibration must be restricted so as to insure that some amount of peroxide is retained also during the defibration. According to the invention, this is accomplished by supplying compressed air to the grinding apparatus in the same manner as described hereinbefore for treating fibrous starting material impregnated solely with alkali. Furthermore, according to the method of the present invention, enough air must be added that the temperature does not exceed 90° C. when the starting material is fed into the grinding zone between the opposed grinding discs. Normally, however, the alkalinity of the fibrous material in the grinding apparatus is still so high that the temperature must be restricted to 80° C., since otherwise the alkali would cause the properties of the pulp to deteriorate.

The process of the invention can be programmed for optimum results in various manners, e.g., for varying starting materials, and, in this connection, one also can choose to operate with such high amounts of added peroxide that considerable quantities of peroxide residues still are present after the defibration. Under the herein indicated conditions of temperature and retention time, continued bleaching can then, according to the invention, be effected by maintaining the pulp, after the defibration, at a high concentration level and at a suitable temperature, namely, 50° C. to 80° C., before it is diluted further to low concentration and/or cooled down.

The method according to the invention of pretreating dewaterer fibrous starting material with alkali and peroxide and then defibrating it at low temperature by supply of air, has proved to be particularly advantageous when it is desired to produce pulp of high brightness from starting materials of deciduous wood species such as birch, aspen, alder or poplar.

In the manufacture of bleached mechanical pulp, it is desirable in most cases wholly or partly to remove consumed alkali or bleaching chemicals and dissolved wood substance or lignocellulose from the produced pulp. This is effected usually by dilution and subsequent dewatering of the produced pulp.

According to the invention, a great portion of the bleaching chemicals and dissolved wood substance can be removed prior to the defibration by compressing the impregnated fibrous starting material Prior to the defibration, the fibrous starting material is considerably easier to compress to a higher dry content than is the finally defibrated pulp. Furthermore, the equipment used for dewatering chips is much cheaper than similar equipment for dewatering finally defibrated pulp to correspondingly high dry contents.

If a more effective removal and possible re-use of bleaching chemicals should be desired, it may be suitable to carry out the impregnation and liquid removal in two or more sUccessive steps. This procedure gives a further advantage in that it makes it easier during the pretreating period to maintain an alkalinity suitable for the bleaching process. The alkali which is supplied in the first impregnation step is consumed to a large extent for neutralization of acid wood constituents. If the starting material should consist of wood chips, the outer portions of each chip will, during the first impregnation step, take up a great portion of the alkali when the bleaching liquid penetrates into the chip. Thus, the alkali in the bleaching liquid will have been consumed to a large extent when the liquid reaches the centre of the chip.

If one should try to avoid this drawback by increasing the alkali content of the bleaching liquid, the outer portions of the chip will be treated with too strong an alkali solution which impairs the brightness and light-scattering properties of the produced pulp.

Due to these circumstances, it is most suitable, according to the invention, to perform the impregnation in two or more steps and therebetween to squeeze out chemicals. The bleaching chemicals which are supplied in the first impregnation step will be consumed rather rapidly by the fresh starting material which has not been treated before with chemicals. This holds especially true with alkali which is contained in the solution of bleaching chemicals. This squeezed-out liquid is consequently not required to be reused, but can be discharged from the plant into an outlet leading to a natural receiver or be destroyed Bleaching liquid added in a subsequent step is introduced by impregnation into wood material which has already been pretreated. Hence, the peroxide content must be higher in order to impart maximum final brightness to the pulp, whereas the content of alkali adjuvant can be relatively minor, since the wood has already been alkalinized in the preceding impregnation step.

The liquid which is squeezed out after a subsequent bleaching step will contain more non-consumed bleaching chemicals and should wholly or partly to be recycled and used for impregnation, preferably in a preceding impregnation step. Prior to its reuse, fresh bleaching chemicals may be added to the squeezed-out liquid, in order to increase the concentration thereof in the bleaching liquid.

It will be understood from the above explanation that bleaching liquid, including eventually recycled squeezed-out liquid, which is added to the material in a preceding bleaching step, must have a higher ratio of alkali to peroxide than the bleaching liquid which is added thereto in a subsequent step.

In connection with chemical impregnation in two or more successive steps with intervening retention time and removal of chemical solution between the impregnation steps, it has been shown to be advantageous to use in the first impregnation step a chemical solution with low peroxide content, possibly no peroxide at all, and subsequently in a following impregnation step to add the main portion of the peroxide.

In order to counteract discoloration in such first impregnation step with little or no peroxide present, a weaker alkaline chemical may be used, e.g., carbonate or bicarbonate. This weaker alkali will also neutralize wood acids and promote the elimination of wood components, such as resin, which are detrimental to the bleaching process or which cause the properties of the resultant pulp to deteriorate.

The effect of the washing or removal of dissolved wood substance and consumed bleaching chemicals becomes greater, the higher the dry content resulting from the squeezing-out operation. Therefore, the compression of the material to be ground must be carried our so that, after the pressing operation, it will have a dry content of at least 35%, or, better yet, at least 40%, and, if possible, at least 50%. It should be understood that the dry content referred to is the dry content of the fibrous starting material. The compression, by way of example, may be effected by screw or hydraulic pressure.

If the bleaching according to the invention is effected by pretreating the starting material with peroxide and alkali, the defibration may be performed at that degree of alkalinity which the starting material has acquired after the treatment. Grinding of strongly alkaline starting material results, however, in a pulp having low light-scattering properties, which is a disadvantage for many fields of application.

If the peroxide in the wood has been consumed for the most part after the last compressing operation, a higher degree of opacity can be obtained according to the invention by totally or partly neutralizing or even slightly acidifying the fibrous raw material prior to he defibration. This acidification has a positive effect on the grindability of the pulp and can advantageously be effected with an acid sulphite or with sulphur dioxide, which in addition, has a reducing effect. By such a final reducing treatment with chemicals, some additional increase of brightness is attained. A further reinforcement of this increase of brightness can be obtained by adding a solution of a suitable hydrosulphite instead of acid sulphite or $SO_2$.

The pulp produced according to the invention is characterized by long fibres and good water-absorbing capacity. Thus, it is well suited for making tissues and other products where high absorption is wanted, such as fill for diapers.

DESCRIPTION OF AN EMBODIMENT OF THE INVENTION

A specific apparatus for carrying out the method according to the invention with impregnation in several steps with bleaching agent Is shown diagrammatically, by way of example, in the accompanying drawing.

Starting material, e.g., such as wood chips, is introduced into the apparatus through a hopper 10, the lower portion of which is connected to a suitably inclined screw conveyor 12. While the wood chips are carried upwards by the conveyor 12, steam is supplied through a pipe 14 to steam heat the chips to about 100° C. The chips then drop through a vertical tube 16 into a pressure dewaterer 18, within which the chips are compressed and water and air present in their pores are removed to a substantial extent. This water is collected in a cup 20 opening into a pipe 22 through which the water is dischaRged from the apparatus. As chemicals have not yet been supplied to the chips, the squeezed-out water can be allowed to escape into a receiver or be recovered for utilization in another phase of the treatment of the fibrous material. The pressure dewaterer 18 may be of the screw type and act against a throttling means such as a valve body (not shown) in front of the outlet, as can be seen in the French Patent Specifications Nos. 1,235,833, 1,254,243 and 1,378,710.

Connected to the discharge side of the pressure dwaterer is a first bleaching vessel 24 which contains a bath of bleaching liquid having a suitable temperature ranging between 55° C. and 65° C. The bleaching liquid may consist of an aqueous solution of peroxide and alkali as main constituents. The mixture of these chemicals is introduced into the vessel 24 through a pipe 26 from a storage tank 28 fOr the chemical solution, the discharge duct 30 from said tank housing a pump means 32, if desired. Liquid-containing alkali only may in addition be supplied to the vessel 24 through the pipe 26 from a separate storage tank 34 via a pipe 38 housing a pump means 36. the vessel 24 is equipped with an agitator member 40 in order to keep the distribution of the chips in the chemical solution as uniform as possible. From the base portion of the vessel 24 extends a duct 42 which houses a pump means 44 and through which the low-consistency chips can be pumped up into a dewaterer 46 of the screw type, for example, and chemicals collected on the bottom thereof can be returned through a duct 48 to the vessel 24. The chips, which now are relieved of a substantial portion of the liquid required for their conveyance, fall down into a vertical tube 50, the bottom portion of which houses one end of a pressure dewaterer 52. The liquid now removed from the interior pores of the chips is collected in a cup 54 and is discharged from the apparatus through a pipe 56. In this liquid, which thus has been squeezed out of the inner pores of the chips, the major part of the chemicals has been consumed, for which reason said liquid may understandably be discharged into the environment.

Thereafter, the compressed mass of chips is allowed to expand in a receptacle 58 below the surface Of bleaching liquid present therein, which results in a fresh quantity of bleaching liquid being sucked into the pores of the chips. This liquid is fed into the receptacle 58 through a pipe 60 from the tank 28. The chips are conveyed upwards by a screw conveyor 62 and discharged through a vertical tube 64 into a second impregnation vessel 66 equipped with an agitator member 68. As in the vessel 24, an increased temperature of, e.g. 55° C.–65° C., also prevails in the vessel 66. After a predetermined period of stay in the second bleaching step, the chips are pumped through a duct 70 by a pump means 72 into a dewaterer 74 which removes the liquid serving as propellant for the chips and which is recycled through a pipe 76 to the vessel 68. The thus dewatered chips fall down through a vertical tube 78 at the bottom of which they again are subjected to strong compression in a pressure dewaterer 80 of the same type as the pressure dewaterers 18 and 52. The squeezed-out chemical solution is collected in a cup 81 and returned therefrom through a duct 82 to the first impregnation vessel 24.

In each of the three pressure dewaterers 8, 52 and 80, respectively, so much liquid is squeezed out that the chips will have a dry content exceeding 35%, and preferably, 40%.

After the double treatment with bleaching agent, the chips are discharged into a pressure receptacle 83 within which a super-atmospheric pressure is maintained by means of a gas and/or steam. From said vessel, the chips are fed by a screw conveyor 84 into a grinding apparatus 86, preferably of the type equipped with two opposed grinding discs. In the pressure receptacle 83, chemicals exercising a reducing or neutralizing effect on the starting material as explained above are supplied through a duct 88. Such chemicals may be hydrosulphite or sulphur dioxide.

Through the duct 88, compressed air also may be fed into the pressure receptacle 83 of the grinding apparatus, in accordance with the present invention.

In order to maintain desired temperature in the two bleaching vessels 24 and 66, heat can be supplied to the same through ducts or pipes associated with the apparatus, and, in addition, the vessels may be heat-insulated.

The vessel 24 contains an aqueous mixture of peroxide and alkali in such composition that the peroxide preponderates. Thus, the liquid supplied to the vessel 58 may contain 2% of peroxide and 0.5% of alkali, e.g., sodium hydroxide, calculated on the bone dry weight of the chips. In the second bleaching step effected in the vessel 66, the bleaching chemicals have approximately the same composition as in the vessel 58. In the bleaching vessel 24, however, the amount of alkali (for example, sodium hydroxide) preponderates, and to this end, alkali only is supplied from the tank 34 simultaneously with the supply of some quantity of chemical solution from the tank 28 to the vessel 24. Thus, the content of alkali calculated on the bone dry weight of the chips in the vessel 24 may amount to 1.5%, while the content of peroxide is 1.0% at the utmost. The total retention time during the bleaching operation shall be kept within the limits stated hereinbefore.

Obviously, the invention is not limited to the shown and described embodiment, but may be varied in the widest sense within the scope of the basic idea thereof as defined in the appended claims.

What is claimed is:

1. In the method of producing wood pulp in a defibrating apparatus in which wood chips, impregnated with an aqueous solution of a peroxide-containing bleaching composition and compressed to a predetermined dry content with consequent removal of bleaching solution, are introduced into a pressure vessel under superatmospheric pressure and then ground between a pair of discs which rotate relative to one another in a pressure sealed defibrating zone connected to said pressure vessel, the improvement. for minimizing the consumption of peroxide, comprising:

(a) impregnating the wood chips with an aqueous solution of alkali, selected from the group consisting of sodium hydroxide, alkali silicate, alkali carbonate and alkali bicarbonate, and peroxide at a temperature ranging between 50° C. and 80° C. and for a correlated period of time ranging between 10 minutes and 2 hours to ensure presence of peroxide in the wood chips upon introduction thereof into the pressure vessel;

(b) dewatering the thus impregnated wood chips by mechanical compression to a dry content between 35% and 50%;

(c) introducing the thus impregnated and dewatered wood chips into said pressure vessel; and (d) introducing compressed air into said pressure vessel in an amount sufficient to maintain the impregnated and dewatered wood chips at a temperature below 90° C. and the pressure vessel at superatmospheric pressure while said impregnated and dewatered wood chips are being passed into said defibrating zone to ensure retention of peroxide during the defibration.

2. Method according to claim 1, in which the wood chips, after the dewatering step and before the defibrating step, are reacted with an acid sulphite or sulphur dioxide to neutralize said wood chips.

3. Method according to claim 2, in which the reaction with the acid sulphite or sulphur dioxide is carried out in the pressure vessel.

* * * * *